United States Patent [19]

Fioravazzi

[11] 4,124,152

[45] Nov. 7, 1978

[54] TRUCK FOR TRANSFER TANKS IN METAL PLANTS, PARTICULARLY FOR STEEL STRAND CASTING PLANTS

[75] Inventor: Franco Fioravazzi, Duisburg, Germany

[73] Assignee: Demag, A.G., Duisburg, Germany

[21] Appl. No.: 749,405

[22] Filed: Dec. 10, 1976

[30] Foreign Application Priority Data

Dec. 20, 1975 [DE] Fed. Rep. of Germany ..... 2557769

[51] Int. Cl.[2] ..... B22D 41/04; B22D 41/08; B22D 41/12

[52] U.S. Cl. ..... 222/604; 164/337; 222/607

[58] Field of Search ..... 222/166, 612, 604, 607, 222/591; 164/281, 337

[56] References Cited

U.S. PATENT DOCUMENTS

| | | | |
|---|---|---|---|
| 2,905,989 | 9/1959 | Black | 164/281 X |
| 3,273,208 | 9/1966 | Greenberger | 164/281 |
| 3,459,312 | 8/1969 | Britcher, Jr. et al. | 222/591 UX |
| 3,817,318 | 6/1974 | Greenberger et al. | 164/281 |

FOREIGN PATENT DOCUMENTS

| | | | |
|---|---|---|---|
| 289,676 | 8/1972 | U.S.S.R. | 164/281 |

*Primary Examiner*—David A. Scherbel
*Attorney, Agent, or Firm*—Mandeville and Schweitzer

[57] ABSTRACT

The invention deals with an intermediary tank truck for metal plants, particularly steel strand casting plants, whose frame consists of two beams and two cross-beams, with the intermediaary or transfer tank resting on the frame, and equipped with a hoisting device between the frame and the intermediary tank, a horizontal adjustment device, a tilting device, and a measuring scale.

12 Claims, 6 Drawing Figures

TRUCK FOR TRANSFER TANKS IN METAL PLANTS, PARTICULARLY FOR STEEL STRAND CASTING PLANTS

BACKGROUND AND STATEMENT OF THE INVENTION

Such intermediary tank trucks transport the intermediary or transfer tanks in preheated condition from a distant heating stand to the casting mold. The conventional truck which moves on rails does not permit sufficient adjustment of the intermediary tank with respect to the most favorable position in which the casting metal enters the strand casting mold. Furthermore, the bottom of the intermediary tanks are provided with so-called immersion tubes which reach below the liquid metal level within the strand casting mold during the casting process. Vertical adjustment of the intermediary tank is accomplished by the hoisting device, and horizontal adjustment by means of the horizontal adjustment device. Furthermore, the intermediary tanks are guarded against tilting.

At the end of a casting process, the slag remaining in the transfer or intermediary tank is removed by tilting the latter. Such tilting requires a special tilting device with relatively powerful gears. Recently, it has become customary to weigh the contents of the intermediary tank during the casting process. From such weighing process, an electric signal for quantity control of the entering casting metal from the casting ladle into the intermediary tank, and from there into the strand casting mold is obtained. This signal may also serve to control the cooling apparatus within the strand casting plant. It is, however, difficult to arrange all such devices for lifting/lowering, horizontal adjustment, tilting and weighing of the intermediary tank on the intermediary tank truck.

It has been previously disclosed to equip an intermediary tank truck with a hoisting device, tilting device and horizontal adjustment drive (German Pat. No. DT-PS 1,558,199). This, however, shows an open arrangement of the most important gears in the broadest sense, particularly the motors, which permits the access of damaging dust particles, heat radiation, gases, vapors, spraying of slag, etc. Damage to the gear parts and/or electrical equipment cannot be avoided. The open arrangement, furthermore, endangers the gear parts during placement and removal of the intermediary tank. Exchange of intermediary tanks is usually done while they are hanging from a crane, so that swinging motions cannot be avoided, which damage not only the gear parts, but also the intermediary tank itself.

The object of the invention is to avoid, as much as possible, the open, unprotected arrangement of the most important parts of the intermediary tank truck, while simultaneously giving better protection to the attendants and still to meet all functions required during the casting process for proper adjustment of the intermediary tank. To this end, the invention proposes to arrange a support for a casting ladle in operating position on one side laterally above the intermediary tank and/or for an overflow gutter next to the intermediary tank; the other side of the intermediary tank truck forms the operative side for hoisting, horizontal adjustment, tilting and weighing devices, for the gear and possible other devices, as well, and that on such operative side are arranged hoisting gear, horizontal adjustment device, as well as a program control for the hoisting gear.

Such layout of the intermediary tank truck eliminates increased access of damaging dust, radiation, gases, vapors, and spraying of slag onto the most important gear parts. Also, the attending staff is protected from the dangers of a hot casting ladle and the casting process itself. One particular advantage is seen in the arrangement of the gears, i.e. the motors, on the operative side, as mechanical means of power transmission, such as the hoisting gears, are protected more easily than electrical means, from influences occurring in metallurgical plants.

In order to facilitate the adjustment of the transfer or intermediary tank relative to the strand casting mold, the invention provides the hoisting gear with two independently movable intermediary tank crossbeams whose ends each rest on a hoisting gear, whereby each hoisting gear in each pair is located in the longitudinal area of a rail and in the area of a wheel axle of the biaxle truck. The advantage of this arrangement is that the functions of hoisting/lowering, tilting and adjusting on a horizontal level can be done by the same means. Furthermore, it is advantageous because the intermediary tank crossbeams as per this invention, can carry exceptionally heavy intermediary tanks. The development of intermediary tank crossbeams permits a simplification of the mating protrusions on the intermediary tank vats. These protrusions may be simple supports instead of pins. High stress on intermediary tank vats based on very long pins is thus reduced. The development of separate intermediary tank crossbeams has the further advantage of lower stress on the beams. The latter may, therefore, have smaller dimensions. Shorter and lower beams permit a better view of the strand casting mold during the casting process. The separation of the intermediary tank crossbeams allows independent movements and thus traverses facilitates a greater tilting angle of the intermediary tank, thus faster and more extensive emptying of slag upon completion of the casting process.

Synchronization of movement of the two ends of one intermediary tank crossbeam is done by a gear connection between the two hoisting gears of the same crossbeam, in such a manner that starting from the hoisting gear located on the operative side, a drive shaft runs on a protected course along the truck crossbeam towards the opposite hoisting gear. Furthermore, it is a goal of the invention to decrease drive power when lifting one or both intermediary tank crossbeams. This goal is attained by having the intermediary tank crossbeams rest on rolls rotatable by means of axles disposed on the hoisting gears.

The basic concept of the invention of safely arranging the gear parts, i.e. protected from external influences, can also be extended to the hoisting gears. Each hoisting gear is arranged in a housing attached to the truck frame, and an inner sleeve solidly attached to the housing forms, with its interior surface, the guide for the hoisting element and, with its exterior surface, the guide for a concentric exterior sleeve surrounding the interior sleeve, such exterior sleeve being affixed to the tip of the hoisting element and carrying at least one supporting roll, which in turn carries the end of an intermediary tank crossbeam. An advantageous design is the telescopic extension of the hoisting element upward. Of particular advantage is also that the base structure for the hoisting element is stationary. The above details form the base for mounting the hoisting gear on the beam. In addition, the attainable height for hoisting is considerably increased because of the telescopic form. The design according to the invention causes better utilization of a long hoisting element whose length corresponds to a great hoisting elevation. The long hoisting element is no longer subject to considerable bending stress, as was previously the case.

Another detail of the invention has each end of the intermediary tank crossbeam fork-shaped, and provides at the exterior hoisting gear sleeve support roll pairs which go below the fork prongs and which are arranged diametrically opposite on the circumference of the sleeve. This has the advantage that the effective portion of the weight force which affects the hoisting gear takes a central course from the intermediary tank weight into the hoisting element. The advantage of a favorably located hoisting element designed for great hoisting elevation can be utilized because the hoisting element consists of a threaded spindle with rotary drive which is axially stationary, and of a threaded nut going through the interior sleeve of the hoisting gear, which is connected to the exterior sleeve via a concentric tube.

Another detail of the invention provides that between the tip of the tube which is attached to the threaded nut and a detachable bottom at the exterior sleeve, one or several flexible joints or springs are arranged. The detachable bottom makes the hoisting gear easily accessible. The flexible joints guard the hoisting element from shocks when the intermediary tank is set on the truck and also during the start of the hoisting process. The design of the hoisting element extending upward permits a further special feature for its attachment. To this end, the hoisting element is seated in the housing attached to the truck frame only with its lower end. Furthermore, the hoisting element consisting of the threaded spindle may be hollow at its lower end, and pivots rotates with play axially and radially in the housing, on the inside opposite a coaxial protrusion of the housing and on the outside with the exterior shaft of the hollow part.

The division into two separate independently movable intermediary tank crossbeams versus previously known intermediary tank trucks has another special effect. If, in another development of the invention each of the two intermediary tank crossbeams is supplemented with a separate gear for horizontal adjustment of the intermediary tank, the latter may be adjusted on a horizontal plane around a perpendicular axis. This has the effect that an intermediary tank rotated on a horizontal plane can be aligned parallel with the strand casting mold.

Another detail of the invention provides that hoisting elevation, length of immersion tubes and intermediary tanks of different sizes are matched. This is done by giving the intermediary tank crossbeams a trough-shaped form at mid-beam and at right angles with the course of direction, whereby vertical support bearings for protrusions affixed to the intermediary tanks are provided on horizontal stepped surfaces arranged in opposed pairs.

The invention provides continuous weighing and measuring of the casting metal level in the intermediary tank, in order to control the casting process. To this end, provision is made between the protrusions or mating surfaces on the intermediary tank and the support bearings on the intermediary tank crossbeams for dynameter cells, which are connected to a meter to indicate the contents of the intermediary tank. The advantage of the interposed dynameter cells is that such cells may be utilized in the most varied dimensions without any special changes of the intermediary tank truck. One overload safety device each is inserted between the dynameter cell resting on the intermediary tank crossbeam and the protrusions of the intermediary tank to protect the dynameter cells.

DETAILED DESCRIPTION OF THE INVENTION

Figure 2:
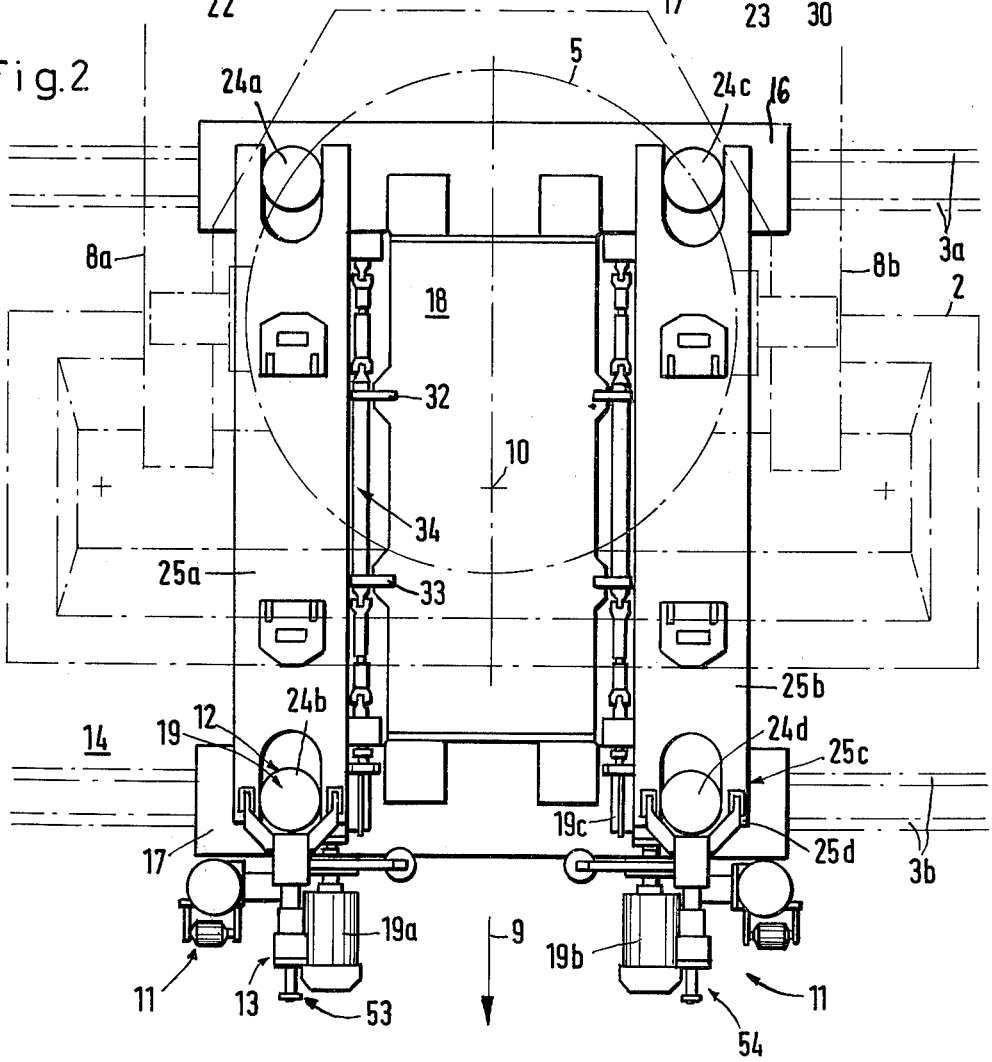
FIG. 2 is a top plan view of the apparatus of FIG. 1.
Figure 3:
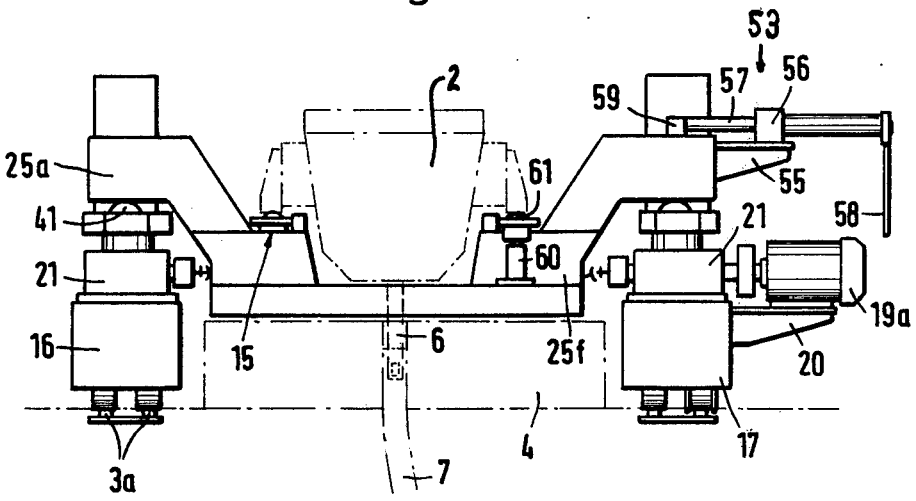
FIG. 3 is an end elevation of the apparatus of FIG. 1, showing the lowered position of a transfer tank thereon.

Intermediary tank truck 1 moves (FIG. 1) intermediary tank 2 (dot-dash line) on casting platform 3 above strand casting mold 4 (FIG. 3). During the casting process, the liquid casting metal (e.g. steel with temperatures of approximately 1400° C. to 1500° C.) flows from casting ladle 5 into intermediary tank 2, through immersion tube 6 into strand casting mold 4, where it chills continuously into strand 7. During this process, casting ladle 5 rests in support 8 consisting of a revolving turret for the ladle with several fork-shaped brackes **8*a* and 8*b*, or of a mobile jack structure (not shown). Intermediary tank truck 1 (FIG. 2) runs on rails 3*a* and 3*b* on the casting platform. The course of the rails is approximately at right angles with respect to casting direction 9, to the left and to the right of the strand casting mold 4**.

Figure 1:
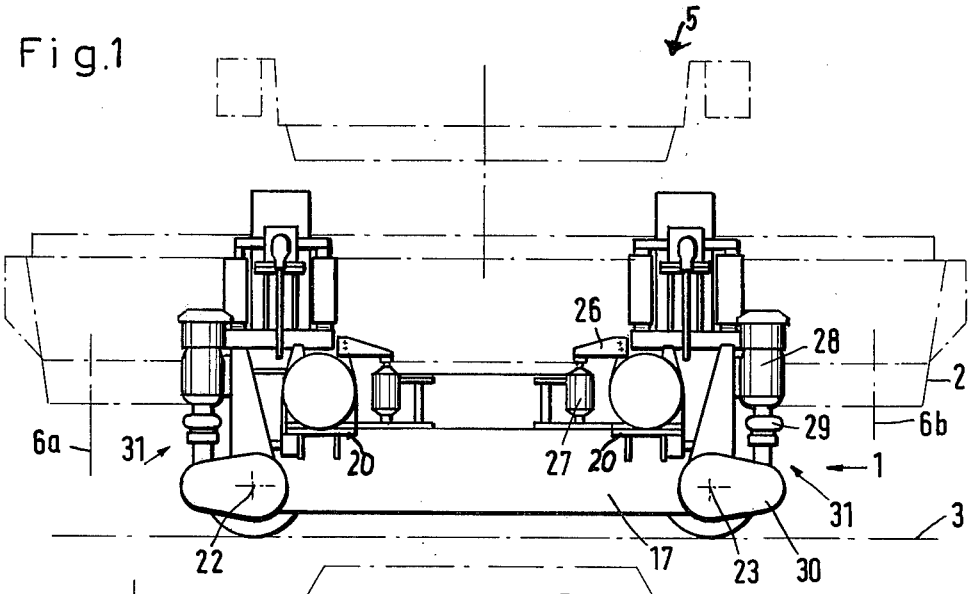
FIG. 1 is a side elevational view of an intermediary or transfer tank truck illustrating the invention, and showing the positioning of a transfer tank and a casting ladle therewith in phantom.

In FIGS. 1, 2 and 3, intermediary tank truck 1 with intermediary tank 2 and casting ladle 5 is in operating position. In this position, the casting metal runs from plug lock 10 indicated into intermediary tank 2, and from there through immersion tubes **6*a* or 6*b* into strand casting mold 4. Intermediary tanks 2 are interchangeable and, with their brick linings, weigh several tons, depending upon their application in single strand or multi-strand casting plants. The operative side 11 of intermediary tank truck 1 opposes casting ladle 5 (FIG. 2). On this operative side 11 are located most of the essential structural groups and the operating controls consisting of hoisting device 12, horizontal adjustment device 13, tilting device 14 which, favorably, is simultaneously formed by the hoisting device, as well as electrical means and measuring devices (meters) for scale 15 and drive gear 31. The frame of the intermediary tank truck consists of longitudinal beams 16 and 17 (FIG. 2), and of one or several truck traverse beams or crossbeams 18. Hoisting gear 19 consists of the two programmed electromotors 19*a* and 19*b*** operated either synchronized or separately, including further aggregates (not shown) to stabilize a hoisting and/or tilting position.

Hoisting device 12 has the following structure and/or function: electromotors **19*a* and 19*b* rest on consoles 20 attached to beam 17. They drive a hoisting gear yet to be described within housing 21, and are actuated by means of program control 19***c*. A housing 21 is located next to each wheel axle 22 and/or 23. Beams 16 and 17 are thus subject to less stress than is the case with known intermediary tank trucks. According to FIG. 2, there are four hoisting gears 24*a*, 24*b*, 24*c* and 24*d*. One hoisting gear pair each 24*a* and 24*b* or 24*c* and 24*d* support one intermediary tank crossbeam 25*a* or 25*b* respectively. Electromotors 19*a* and 19*b* are equipped with belt brakes 26, which are operated by means of cylinder piston gears 27.

Next to each hoisting gear, drive gear 31 is formed by a vertically arranged motor 28, clutch 29 and gear 30 next to each wheel axle 22 and 23. This arrangement is so favorable that drive gear 31 at each wheel axle 22 and 23 is next to intermediary tank truck 1 on the outside, and each hoisting gear 19 on the inside. This distribution of gears facilitates the realization of the goal of the invention, which is a protected arrangement for all important gear parts. The motive power of hoisting gears 19 arranged unilaterally at intermediary tank truck 1 is transmitted by means of a drive shaft 34 passing through rotary bearings 32 and 33; shaft 34 consists of flexible shaft 34*a* (Cardan shaft) and runs along truck crossbeam 18 to opposite hoisting gear 24*a* or 24*c*.

Figure 6:
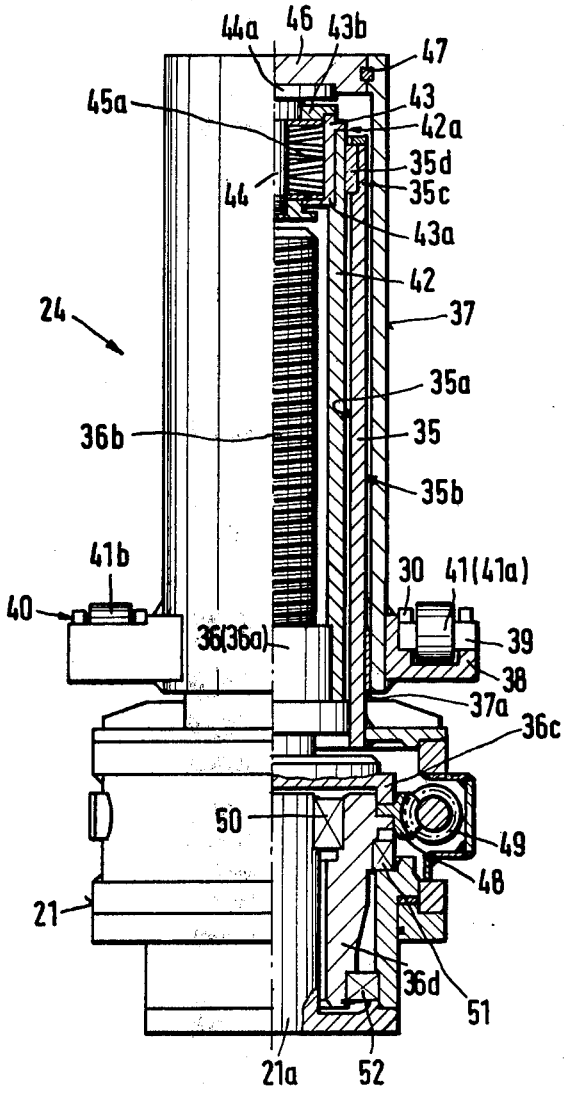
FIG. 6 is an enlarged detailed showing of the hoisting gear of the invention in elevation and partly in cross section.

Hoisting gears 24 are shown in detail on FIG. 6; housing 21 is attached to one of beams 16 or 17 and extends as inner sleeve 35 is perpendicular to beams 16 or 17 forming a column. Hoisting element 36 consisting of threaded nut 36*a* slides along interior surface 35*a* of sleeve 35, and concentric outer sleeve 37 slides along the exterior surface 35*b*. Rotary bearings 38 for support rolls 41, equipped with axles 39 and 40, are connected to the outer sleeve 37, which can be raised and lowered. Two support rolls 41*a*, 41*b* each support the end 25*c* of intermediary tank crossbeam 25. Each intermediary tank crossbeam 25 comes with fork-shaped end 25*c* with fork prongs 25*d* (FIG. 1).

Hoisting element 36 includes a threaded spindle 36*b* besides threaded nut 36*a*. Concentric tube 42 is rigidly connected with threaded nut 36*a*. In retracted position of the hoisting gear, tube 42 extends beyond the end of threaded spindle 36*b*. The tip 42*a* of tube 42 is fitted with an annular extension 43, whose two openings each come with end caps 43*a* and 43*b* forming an edge. In caps 43*a* and 43*b* a rod 44 may be shifted, and on the rod between the stationary lids 43*a* and 43*b* flexible joints 45 in the form of plate springs 45*a* are arranged. Rod head 44*a*, together with detachable bottom 46, form a connection between tip 35*c* of tube 35 and outer sleeve 37. Power is transmitted by dog 47 consisting of a tangential wedge with the detachable bottom. Outer sleeve 37 has two displaceable bearings, namely, on inner sleeve 35, by means of sleeve bearings 37*a* and on tube 42*a*, by means of sleeve bearing 35*d*.

Hoisting element 36, i.e., threaded spindle 36*b*, is only seated in housing 21 with end 36*c*. Such end 36*c* forms hollow part 36*d* and is connected to worm wheel 48 engaging with worm 49. Worm 49 has a rotary bearing in housing 21 and is connected with drive pulley 34 through the housing 21 wall and/or to the drive shaft of hoisting gear 19 on operative side 11 (not shown). Housing 21 forms coaxial extension 21*a* against threaded spindle 36*b*, and extension 21*a* forms support for hollow part 36*d*, by means of radial rotary bearing 50. Between hollow part 36*d* and housing 21 support is given by axial rotary bearing 51 and radial rotary bearing 52. Threaded spindle 36*b*, its lower end 36, worm wheel 48 and hollow part 36*d* form an interconnected unit. The above described hoisting gear 24 permits a simple constructive extension of hoisting element 36 without having to change its rotary bearing 50, 51, 52 or worm gear 48, 49. Nevertheless, hoisting gear 24 forms a closed structural unit protected from external influences.

Horizontal adjustment device 13 for the two separate intermediary tank crossbeams 25*a* and 25*b* is illustrated by FIGS. 1 and 3; each intermediary tank crossbeam 25*a* and 25*b* has a separate gear 53 and 54. The gear rests on console 55 with spindle nut 56 at rotary bearings 38 (FIG. 6) and/or outer sleeve 37 of hoisting gear 24. Gears 53 and 54 are preferably height-adjustable themselves along with the height-adjustable part of the related adjacent hoisting gear 24. Threaded spindle 57, when turning, displaces intermediary tank crossbeam 25 by means of lever 58 via abutment 59, depending upon rotational direction, whereby this displacement is accomplished on support rolls 41 (FIG. 6) without requiring much power.

Figure 4:
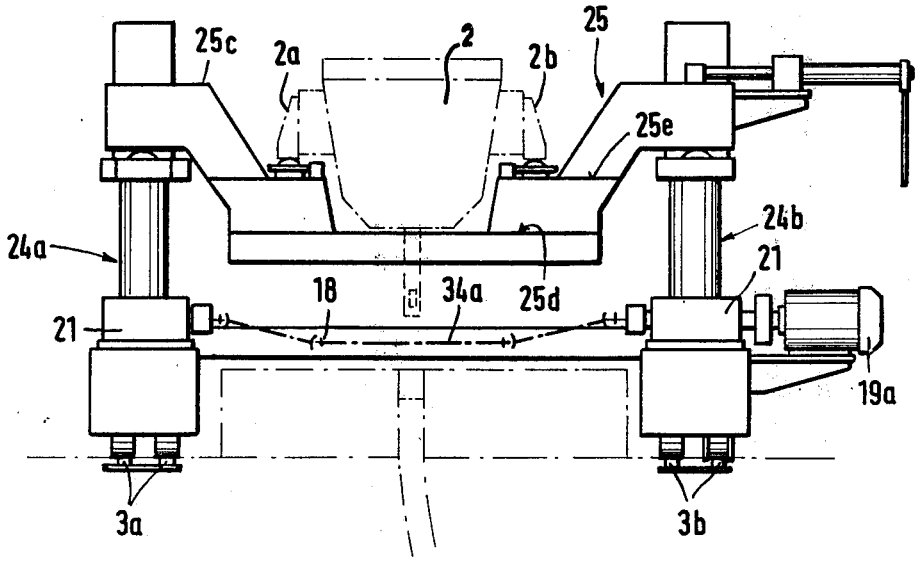
FIG. 4 is the same view as FIG. 3, with the tank in raised position.
Figure 5:
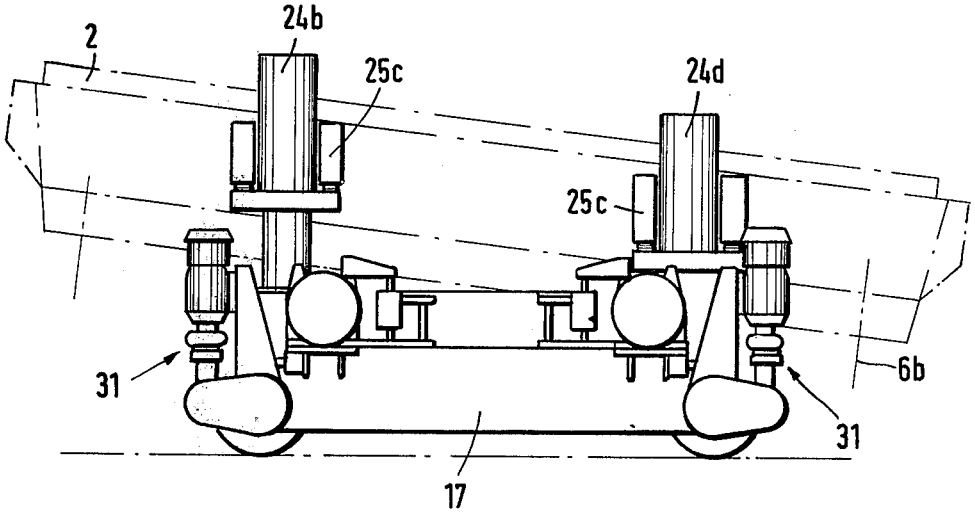
FIG. 5 is a side elevation similar to FIG. 1, showing a tank in tilted position.

Tilting device 14 is based on the independent operation of intermediary tank crossbeams 25*a* and 25*b*, further on separate gears 53 and 54 of horizontal adjustment device 13 and on hoisting gears 24*a*, 24*b*, 24*c* and 24*d*, each forming an independent structural unit. According to FIG. 5, only hoisting gear pair 24*a* and 24*b* is actuated, which causes tilting to the right, i.e., pouring out of the liquid slag from immersion tube and/or spout 6*b*. The tilting device of this invention achieves a far greater tilting angle than known devices due to its design. Measuring scale 15 according to FIGS. 3 and 4 is based on trough-shaped form 25*c* of intermediary tank crossbeam 25. Horizontal stepped surfaces 25*d*, 25*e* form the base for the vertical supports, i.e. protrusions 2*a* and 2*b* of intermediary tank 2. Stepped surfaces 25*d*, 25*e* form a hollow 25*f* (FIG. 3). This houses dynameter cells 60 by means of which the weight of intermediary tank 2 and/or indirectly the volume of the casting metal in intermediary tank 2 at any given time. There are four dynameter cells 60 for one intermediary tank 2; they are electrically combined and connected to a meter, which is not shown. Any overload of the dynameter cells 60 is avoided by commercial overload safety devices 61. Hollow 25*f* can be used favorably for any type of smaller or larger dynameter cells 60. Dynameter cells 60 are housed in this space, protected from external influences also. The measuring scale further operates independently of the hoisting position of synchronized intermediary tank crossbeams 25*a* and 25*b*.

I claim:

1. A transfer truck for intermediary tanks in steel mills, such as steel strand casting plants, comprising (a) a frame including a pair of longitudinally extending side beams and a pair of crossbeams extending between said side beams;

(b) means on said frame for adjusting an intermediary tank supported by said truck, said adjusting means including a vertical hoisting device, a tank horizontal positioning device, a tank tilting device, a weight measuring device; characterized by (c) operating means for all said adjusting means disposed on one side of said transfer truck;

(d) a casting ladle and support therefor for charging a tank supported on said truck positioned on the side of said truck opposite said operating means;

(e) a pair of axles extending between said side beams and supported therein;

(f) wheels disposed on each end of said pair of axles;

(g) each end of each said crossbeam supported on said side beams by a hoisting gear; and (h) each said hoisting gear positioned on said side beams adjacent said axles.

2. The apparatus of claim 1, further characterized by (a) a drive axle interconnecting each pair of said hoisting gears positioned at opposite ends of each crossbeam; and (b) said drive axles extending along said crossbeams.

3. The apparatus of claim 2, further characterized by (a) roller means interconnecting each end of each said crossbeam with its respective hoisting gear.

4. The apparatus of claim 3, further characterized by (a) a gear housing fixed on said side beams adjacent each end of each said crossbeam;

(b) an inner sleeve fixed to each said gear housing and forming the guide for said hoisting gear;

(c) an outer sleeve positioned concentrically with said inner sleeve and movable relative thereto;

(d) a vertical hoisting element disposed in said inner sleeve and movable relative thereto;

(e) the top of said hoisting element affixed to said outer sleeve; and (f) at least one support roll means fixed to said outer sleeve;

(g) said support roll supporting the said adjacent end of said crossbeam.

5. The apparatus of claim 4, further characterized by (a) each end of each said crossbeam being forked;

(b) said support roll means include two support rolls diametrically positioned on said outer sleeve; and (c) each side of said forked end engaging one of said support rolls.

6. The apparatus of claim 4, in which each said hoisting element is characterized by (a) a rotary driven threaded spindle;

(b) a threaded nut cooperating with said spindle;

(c) a concentric tube fixed to said threaded nut and movable axially along the inner surface of said fixed inner sleeve; and (d) means connecting said concentric tube and said outer sleeve at the upper ends thereof.

7. The apparatus of claim 6, further characterized by (a) said connecting means includes resilient means.

8. The apparatus of claim 4, further characterized by (a) said hoisting element including a lower annular element;

(b) said gear housing including a fixed lower tubular extension; and (c) said lower annular element rotatable around said lower tubular extension.

9. The apparatus of claim 1, further characterized by (a) a horizontal gear means connected to each said crossbeam on the operating means side of said apparatus.

10. The apparatus of claim 1, further characterized by (a) the intermediate sections of each said crossbeam includes a stepped portion; and (b) said stepped portion including horizontal recesses for engaging cooperating surfaces on a tank to be supported.

11. The apparatus of claim 10, further characterized by (a) dynameter cells disposed on said horizontal recesses for engaging said cooperating surfaces; and (b) means connected to said cells for the reading thereof.

12. The apparatus of claim 11, further characterized by (a) overload safety means connected to said dynameter cells for engaging said cooperating surfaces.

* * * * *